US006579129B2

(12) United States Patent
Sato

(10) Patent No.: US 6,579,129 B2
(45) Date of Patent: Jun. 17, 2003

(54) CONNECTOR ASSEMBLY

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/793,080

(22) Filed: Feb. 27, 2001

(65) Prior Publication Data

US 2002/0115354 A1 Aug. 22, 2002

(30) Foreign Application Priority Data

Feb. 28, 2000 (JP) ..... 2000-051839

(51) Int. Cl.[7] ..... H01R 11/09
(52) U.S. Cl. ..... 439/724; 439/701; 439/456
(58) Field of Search ..... 439/701, 721, 439/723, 724, 456, 452, 460, 459, 457, 465, 466, 458, 262, 259–261

(56) References Cited

U.S. PATENT DOCUMENTS 4,386,820 A * 6/1983 Dola et al. ..... 439/651
5,888,103 A * 3/1999 Norizuki et al. ..... 439/701
6,319,071 B1 * 11/2001 Sato ..... 439/701

FOREIGN PATENT DOCUMENTS

JP 10-50361 * 2/1998 ..... R01R/4/24

* cited by examiner

*Primary Examiner*—P. Austin Bradley
*Assistant Examiner*—Ross Gushi
(74) *Attorney, Agent, or Firm*—Finnegan, Henderson, Farabow, Garrett, & Dunner, L.L.P.

(57) ABSTRACT

Connectors are stacked vertically in multi-steps for integration. Terminals are in the connectors. The terminals are insert joined in substantially a normal direction relative to a direction of drawing out wires from the connectors. The connectors have wire bending parts bending the wires. The wire bending parts are for reducing force and vibrations to be applied to the wires.

5 Claims, 1 Drawing Sheet

CONNECTOR ASSEMBLY

BACKGROUND OF THE INVENTION

Figure 1:
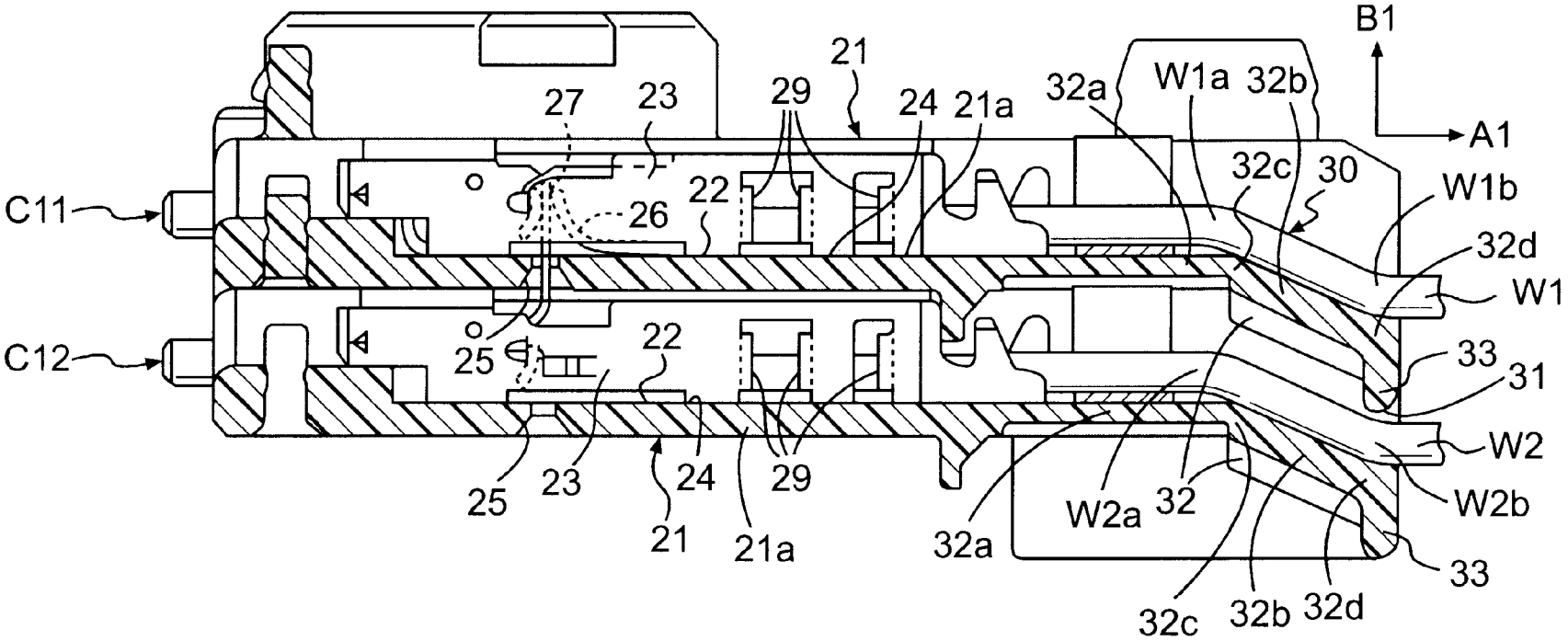

The present invention relates to a connector assembly which has a plurality of connectors vertically multi-stacked.

A connector assembly is constituted such that a pair of identical connectors are stacked vertically in two steps for integration. The respective connectors have identically configured connector housings, and insulation displacing terminals accommodated in respective terminal accommodating chambers of housings. The terminals have insertion connecting pieces and fit-in parts.

When upper and lower connectors are integrated, connecting pieces of terminals of the lower connectors are inserted in fit-in parts of terminals of the upper connectors housing, and the terminals of the upper and lower connectors are electrically joined.

Wires are pressed to the terminals for contact on bottom faces of the connector housings. The wires are straightly drawn out outside through wire drawing-out ports formed between the upper and lower connectors.

SUMMARY OF THE INVENTION

The connector assembly, however, has a drawn-out direction of the wires normal to an insertion direction of the connecting pieces. If force or vibrations are applied to the wires outside the connectors, influence extends directly to contact parts of the connecting pieces and the fit-in parts, and contact failures can occur at the contact parts due to slightly sliding abrasion.

It therefore is an object of the present invention to provide a connector assembly in which influence does not extend to contact parts between terminals if force or vibrations are applied to wires outside connectors.

A first aspect of the invention provides a connector assembly. Connectors are stacked vertically in multi-steps for integration. Terminals are in the connectors. The terminals are insert joined in substantially a normal direction relative to a direction of drawing out wires from the connectors. The connectors have wire bending parts bending the wires. The wire bending parts are for reducing force and vibrations to be applied to the wires.

Preferably, the wire bending parts are formed such that wire drawing-out ports are vertically away from terminal placing faces of connector housings. The wire drawing-out ports are formed between the connector housings by integration of the connectors.

According to the aspect, the wire bending parts make wire lengths between terminal connecting parts and ends of the wire drawing-out parts thereof sufficiently ensured, and reduce forces and vibrations to be applied to the wires outside the connectors, so that the vibrations do not transmit to the terminal connecting parts.

With simple structures of the wire drawing-out ports and without structures further with another members for bending the wires, all the wire arranged transversely are uniformly bent.

The wire drawing-out ports establish drawing-out configurations and directions of the wires. Locations of the wire drawing-out ports make the wires for introducing outside bent, and by vertically stacking the connectors for integration, the wires are automatically bent, so that contact parts of the terminals are to be protected.

A second aspect of the invention provides a connector assembly. The assembly includes connectors stacked each other. The connectors include wires are joined with terminals. Housings are for placing the wires. The housings include passages introducing the wires to ports. The passages are bent at the ports.

Preferably, the ports are reduced relative the passages.

BRIEF DESCRIPTION OF THE ACCOMPANYING DRAWINGS

The above and further objects and novel features of the present invention will more fully appear from the following detailed description when the same is read in conjunction with the accompanying drawing, in which:

FIGURE is a side sectional view of an embodiment of the invention.

DETAILED DESCRIPTION OF THE PREFERRED EMBODIMENTS

There will be detailed below the preferred embodiments of the present invention with reference to the accompanying drawings.

As shown in FIGURE (FIG.), a connector assembly has identically configured connectors C11, C12 that are stacked vertically in two steps for integration. The connectors C11, C12 respectively have identically configured connector housings 21, insulation displacing terminals 23 that are respectively accommodated in respective terminal accommodation chambers of the housings 21.

The terminals 23 have insertion connecting pieces 27 and insertion fit-in parts 26 at front parts, and insulation displacing blades 29 at rear parts. The terminals 23 are mounted on terminal placing faces 24 formed of upper faces of bottom walls 21*a* of the housings 21.

The connecting pieces 27 each are composed of a spring piece that is to be raised upward (B1 direction) substantially normal to a drawn-out direction of wires W1, W2 from the connectors C11, C12. A first connecting piece 27 of a first terminal 23 of an first connector C11 keeps lying down. A second connecting piece 27 of a second terminal 23 of a second connector C12 is raised.

The connecting pieces 27 are to be raised or to keep lying down in accordance with necessity. The second terminal 23 is necessary to be electrically joined with the first terminal 23 of the first connector C11, and only the second connecting piece 27 is raised. The first connecting piece 27 is to be raised if another connector (not shown in FIGURE) is stacked on the first connector C11 when an insulation displacing terminal of the connector need to be electrically joined with the first terminal.

A fit-in part 26 is structured such that the second connecting piece 27 of the second connector C12 is smoothly received when it is inserted from a lower position through a through-hole 25 provided to a bottom face 21*a* of the first connector C11.

When the first and second connector C11,C12 are stacked and integrated each other, the second connecting piece 27 of the second connector C12 is inserted in the fit-in part 26 of the first connector C11, and the first terminal 23 of the first connector C11 and the second terminal 23 of the second connector are electrically joined each other.

In the connector assembly, at wire drawn-out parts 30 for drawing out wires W1, W2 outside, wire bending parts 32 are provided to bend the wires W1, W2 to be drawn out outside for reducing force and vibrations to be applied to the wires W1, W2. Bending parts 32 are each formed such that wire drawing-out port 31 is at a lower position away form the terminal placing face 24. The drawing-out port 31 is formed between housings 21 by integrating the first connector C11 and the second connector C12 each other. The bottom walls 21*a* of the drawn-out parts 30 are inclined downwardly oblique, and the drawing-out port 31 is formed at a position downward away from the placing face 24.

At lower rear faces of bottom walls 21*a*, end walls 33 for reducing the drawing-out port 31 from an upper position are formed. The end walls 33 play a role of an obstacle board to keep the wires W1, W2 being bent if the wires W1, W2 outside the connectors are lifted upwardly.

Specially, the wire bending parts 32 have base parts 32*a* extending straightly from the bottom walls 21*a*, inclined parts 32*b* extending obliquely from the base parts 32*a* to end walls 33, first bent parts 32*c* between the inclined parts 32*b* and the base parts 32*a*, and second bent parts 32*d* between the inclined parts 32*b* and the end walls 33.

Next, a function is explained.

In assembling the connector assembly, the terminals 23 are accommodated in the housings 21. In this step, the wires W1, W2 may have been joined with the terminals 23, or the wires W1, W2 may be joined with the terminals after inserting the terminals in the housings 21.

Next, the housings 21 of the connectors C11, C12, with the wires W1, W2 connected, are integrated each other. At same time, the connecting piece 27 of the second connector C12 is inserted in the fit-in part 26 of the first connector C11, so that the terminals 23 of the first and second connectors C11, C12 are electrically joined.

The wires W1, W2 extending rearward from the terminals 23 each is drawn out outside from the drawing-out port 31, being forcedly bent by the bending parts 32.

Specially, the first bending parts 32*a* bend first portions W1*a*, W2*a* of the wires W1, W2, and the second bending parts 32*d* bend second portions W1*b*, W2*b* of the wires W1, W2.

Thus, if force or vibrations are applied to the wires W1, W2 outside the connectors, the bending parts 32 reduce them, and the force or vibrations do not transmit to contact parts of the connecting pieces 27 and the fit-in parts 26, and, as a result, slightly sliding abrasions are solved.

While preferred embodiments of the present invention have been described using specific terms, such description is for illustrative purposes, and it is to be understood that changes and variations may be made without departing from the spirit or scope of the following claims.

What is claimed is:

1. A connector assembly comprising:

connectors stacked vertically in multi-steps for integration; and terminals in the connectors, the terminals being joined by a portion of a first terminal inserted into a portion of a second terminal in a substantially normal direction relative to a direction of drawing out wires from the connectors, wherein the connectors have wire bending parts bending the wires, the wire bending parts for reducing force and vibrations applied to the wires, and wherein the wire bending parts are formed such that wire drawing-out ports are vertically away from terminal placing faces of connector housings, wherein the wire drawing-out ports are formed between the connector housings by integration of the connectors.

2. A connector assembly comprising:

connectors stacked adjacent to each other, the connectors including;

wires joined to terminals; and housings for placing the terminals with the wires, the housings including passages introducing the wires to ports, the passages being bent at the ports, wherein a portion of at least one terminal of the connectors is inserted into the terminal of a neighboring connector for electrical connection through the neighboring connector, and wherein the ports are reduced relative to the passages.

3. A connector assembly comprising:

connectors stacked vertically in multi-steps for integration; and terminals in the connectors, the terminals being joined by a portion of a first terminal inserted into a portion of a second terminal in a substantially normal direction relative to a direction of drawing out wires from the connectors, the wires extending from drawing-out ports formed between connector housings by integration of the connectors, wherein the connectors have wire bending parts bending the wires, the wire bending parts being configured to reduce force and vibrations applied to the wires.

4. A connector assembly comprising:

connectors stacked vertically in multi-steps for integration; and terminals in the connectors, the terminals being joined by a portion of a first terminal inserted into a portion of a second terminal in a substantially normal direction relative to a direction of drawing out wires from the connectors, wherein the connectors have first and second wire bending parts bending the wires at a first and second bending portion, respectively, the wire bending parts configured to reduce force and vibrations applied to the wires, wherein wire drawing-out ports are formed between the connector housings by integration of the connectors.

5. A connector assembly according to claim 4, wherein the wire bending parts are formed such that wire drawing-out ports are vertically away from terminal placing faces of connector housings.

* * * * *